US009826578B2

(12) United States Patent
Viroli et al.

(10) Patent No.: US 9,826,578 B2
(45) Date of Patent: Nov. 21, 2017

(54) INDUCTION COOKING HOB WITH A PLURALITY OF INDUCTION COILS

(71) Applicant: Electrolux Home Products Corporation N. V., Brussels (BE)

(72) Inventors: Alex Viroli, Forli (IT); Svend Erik Christiansen, Forli (IT); Andrea Fattorini, Forli (IT); Laurent Jeanneteau, Forli (IT)

(73) Assignee: Electrolux Home Products Corporation N.V., Brussels (BE)

( * ) Notice: Subject to any disclaimer, the term of this patent is extended or adjusted under 35 U.S.C. 154(b) by 178 days.

(21) Appl. No.: 14/396,194

(22) PCT Filed: May 21, 2013

(86) PCT No.: PCT/EP2013/060399
§ 371 (c)(1),
(2) Date: Oct. 22, 2014

(87) PCT Pub. No.: WO2013/178503
PCT Pub. Date: Dec. 5, 2013

(65) Prior Publication Data

US 2015/0083712 A1 Mar. 26, 2015

(30) Foreign Application Priority Data

May 29, 2012 (EP) ..... 12169798

(51) Int. Cl.
*B02B 3/02* (2006.01)
*H05B 6/12* (2006.01)
(Continued)

(52) U.S. Cl.
CPC ..... *H05B 6/1209* (2013.01); *F24C 7/087* (2013.01); *H05B 6/062* (2013.01); *H05B 6/1272* (2013.01);
(Continued)

(58) Field of Classification Search
CPC .... H05B 6/062; H05B 6/1209; H05B 6/1272; H05B 2213/03; H05B 2213/05; F24C 7/087
(Continued)

(56) References Cited

U.S. PATENT DOCUMENTS 7,554,060 B2 6/2009 England et al.
D696,893 S * 1/2014 Meda ..... D7/346
(Continued)

FOREIGN PATENT DOCUMENTS

CN 101690390 A 3/2010
DE 4405610 5/1995
(Continued)

OTHER PUBLICATIONS

English Translation of Office action issued in Chinese Patent Application No. 201380025483.4, dated Jul. 29, 2015, 12 pages.
(Continued)

*Primary Examiner* — Thien S Tran
(74) *Attorney, Agent, or Firm* — Pearne & Gordon LLP

(57) ABSTRACT

The present invention relates to an induction cooking hob (10) with a plurality of induction coils (16). The induction cooking hob (10) comprises a cooking surface (12) and a control unit. The cooking surface (12) includes a cover plate. The induction coils (16) are arranged side-by-side according to a predetermined scheme and below the cover plate. At least one induction coil (16) is marked by an identification symbol (18). The identification symbol (18) includes a first element (20) and a second element (22), wherein the first element (20) extends beyond the diameter of the corresponding induction coil (16) and the second element (22) marks the diameter of said induction coil (16).

15 Claims, 1 Drawing Sheet

(51) Int. Cl.
*H05B 6/06* (2006.01)
*F24C 7/08* (2006.01)

(52) U.S. Cl.
CPC ..... *H05B 2213/03* (2013.01); *H05B 2213/05* (2013.01)

(58) Field of Classification Search
USPC ..... 219/121.48, 445.1, 448.11, 452.11, 622, 219/627, 635
See application file for complete search history.

(56) References Cited

U.S. PATENT DOCUMENTS

2007/0164017 A1* 7/2007 Gouardo ..... H05B 6/065 219/626
2008/0099449 A1* 5/2008 England ..... F24C 7/082 219/121.48
2010/0206871 A1* 8/2010 Kataoka ..... H05B 6/062 219/622
2011/0011851 A1* 1/2011 Kataoka ..... H05B 6/1218 219/622

FOREIGN PATENT DOCUMENTS

DE 4405610 A1 * 8/1995 ..... F24C 7/083
DE 102010031225 2/2011
EP 1030537 8/2000
EP 2173137 4/2010

OTHER PUBLICATIONS

International Search Report for PCT/EP2013/060399, dated Sep. 5, 2013, 3 pages.

* cited by examiner

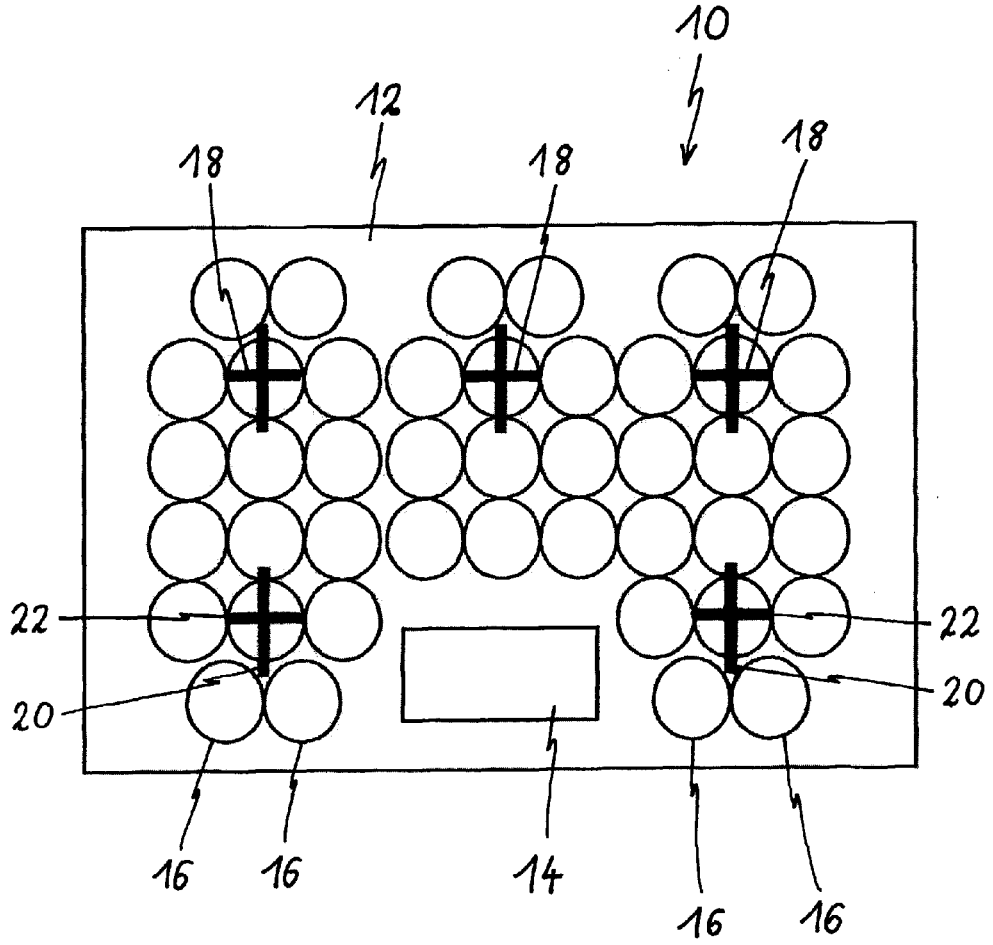
10
12
18
18
18
22
22
20
20
16
16
14
16
16

INDUCTION COOKING HOB WITH A PLURALITY OF INDUCTION COILS

BACKGROUND OF THE INVENTION

The present invention relates to an induction cooking hob with a plurality of induction coils.

An induction cooking hob includes a number of induction coils. The induction coils are arranged below a cooking surface. Further, the induction coils are arranged side-by-side to each other. Usually, the cooking surface is formed by a glass ceramic panel.

In one type of induction cooking hobs, each induction coil corresponds with a cooking zone. In order to recognize the cooking zone by the user, there is an identification symbol on the cooking surface. For example, the identification symbol is a ring covering the area above the corresponding cooking zone. Further, the identification symbol may be a cross arranged in the centre of the cooking zone.

In another type of induction cooking hobs, a plurality of small induction coils are arranged as a matrix below the glass ceramic panel. A pot detection system identifies those induction coils, which are covered by a pot. Then, a control unit of the cooking hob activates those induction coils, which are completely or partially covered by the pot. This system is efficient, if the bottom area of the pot is bigger than the areas of the induction coils. However, if the bottom area of the pot is equal as or smaller than the areas of the induction coils, then the pot may only cover small parts of neighboured induction coils. In this case, either the pot detection system does not recognize the pot, or the area of the activated induction coils is much bigger than the bottom area of the pot. Thus, this concept is only suitable for pots with a bottom area clearly larger than the area of the induction coils.

EP 2 192 820 A1 discloses a cooking hob with a plurality of induction coils arranged in a grid. According to one example, a part of the cooking surface comprises smaller induction coils that the remaining cooking surface. In said part of the cooking surface the induction coils are arranged as a matrix with three lines and three columns. The central induction coil of said matrix is marked by an identification symbol on the cooking surface. The identification symbol is a small cross above the centre of the central induction coil or a ring arranged concentrically to the induction coil. However, an exact arrangement of cooking pots is not possible, when the bottom area of the pot is bigger than the dimension of the identification symbol.

BRIEF SUMMARY OF THE INVENTION

It is an object of the present invention to provide an induction cooking hob with a plurality of induction coils, which allows an exact arrangement of small cooking pots.

The object of the present invention is achieved by the induction cooking hob according to claim 1.

According to the present invention the identification symbol includes a first element and a second element, wherein the first element extends beyond the diameter of the corresponding induction coil and the second element marks the diameter of said induction coil.

The main idea of the present invention is that one element of the identification symbol extends beyond the area of the induction coil, so that the user can recognize the induction coil also, if said induction coil is covered by a cooking pot on the one hand, and another element marks the area of the induction coil 16. If the bottom area of the cooking pot is marginally bigger than the area of the corresponding induction coil, then the user may exactly place the cooking pot above the induction coil. The user can place the cooking pot concentrically to the induction coil, which allows a maximum power transfer.

In particular, the identification symbol is a cross, wherein the first element and the second element are formed as stripes of said cross.

For example, the cross includes a longitudinal stripe and a transverse stripe, wherein the longitudinal stripe extends beyond the diameter of the corresponding induction coil and the transverse stripe marks the diameter of said induction coil.

Alternatively, the cross includes a longitudinal stripe and a transverse stripe, wherein the transverse stripe extends beyond the diameter of the corresponding induction coil and the longitudinal stripe marks the diameter of said induction coil.

Further, the induction cooking hob may comprise a pot detection system for detecting the presence and/or the position of a cooking pot on the cooking surface.

For example, the pot detection system activates those induction coils, which are completely covered by a cooking pot.

Alternatively or additionally, the pot detection system activates those induction coils, which are at least partially covered by a cooking pot, wherein a predetermined minimum portion of the area of said induction coils must be covered.

According to a preferred embodiment of the present invention, the at least one induction coil marked by the identification symbol has a diameter between 50 mm and 90 mm, in particular 70 mm.

Preferably, the at least one induction coil marked by the identification symbol is provided for a cooking pot, wherein the bottom area of said cooking pot has a diameter between 50 mm and 90 mm.

In particular, the induction coils are arranged as a matrix, wherein the cooking surface comprises at least one portion, in which the induction coils have the same diameters.

Further, the identification symbol may be applied on the cover plate of the cooking surface.

Preferably, at least one of the smallest induction coils of the cooking surface is marked by the identification symbol.

Additionally, the induction cooking hob comprises a user interface electrically connected to the control unit and/or to the pot detection system.

In particular, the cover plate is a glass ceramic panel.

Novel and inventive features of the present invention are set forth in the appended claims.

BRIEF DESCRIPTION OF THE DRAWING

The present invention will be described in further detail with reference to the drawing, in which FIG. 1 illustrates a schematic top view of an induction cooking hob according to a preferred embodiment of the present invention.

FIG. 1 illustrates a schematic top view of an induction cooking hob 10 according to a preferred embodiment of the present invention.

DETAILED DESCRIPTION OF THE INVENTION

The induction cooking hob 10 comprises a cooking surface 12 and a user interface 14. The cooking surface 12 includes a cover plate. Preferably, the cover plate is a glass ceramic panel. The user interface 14 may be a touch-key panel or a touch screen. The induction cooking hob 10 comprises a control unit, which is not explicitly shown in FIG. 1. The control unit is electrically connected to the user interface 14.

A plurality of induction coils 16 is arranged below the cover plate of the cooking surface 12. The induction coils 16 are arranged as a matrix. The induction coils 16 are relative small. In this example, the induction coils 16 have the same diameters. Further, the induction coils 16 of this embodiment have a diameter of about 70 mm in each case.

The induction cooking hob 10 shown in FIG. 1 comprises 43 induction coils 16 at all. A first front line of the matrix comprises four serial induction coils 16, wherein said first front line is interrupted by the user interface 14. A second front line of the matrix comprises six serial induction coils 16, wherein said second front line is also interrupted by the user interface 14. Three lines in the central portion of the cooking surface 12 comprise nine serial induction coils 16 in each case. A rear line of the matrix comprises six serial induction coils 16.

Some of the induction coils 16 are marked by an identification symbol 18. In this example, five induction coils 16 are marked by the identification symbol 18. Said five induction coils 16 are equally distributed over the cooking surface 12. There are at least two induction coils 16 without identification symbol 18 between two neighboured induction coils 16 marked by the identification symbol 18.

The identification symbol 18 covers the corresponding induction coil 16. In this example, the identification symbol 18 is formed as a cross. The cross 18 includes a longitudinal stripe 20 and a transverse stripe 22. The length of the longitudinal stripe 20 extends beyond the diameter of the induction coil 16, while the length of the transverse stripe 22 is identical with the diameter of the induction coil 16.

In general, the identification symbol 18 includes at least two elements, wherein at least one element extends beyond the diameter of the induction coil 16 and at least one other element marks the diameter of the induction coil 16.

Since the length of the longitudinal stripe 20 extends beyond the diameter of the induction coil 16, the user can recognize this induction coil 16, if a cooking pot 16 covers the induction coil 16, wherein the bottom area of said cooking pot 16 is marginally bigger than the area of the induction coil 16. The longitudinal stripe 20 allows that the user may place the cooking pot concentrically to the induction coil 16, if the bottom area of the cooking pot 16 is marginally bigger than the area of the corresponding induction coil 16.

Since the length of the transverse stripe 22 is identical with the diameter of the induction coil 16, the user recognizes the area of the induction coil 16. If the induction cooking hob 10 comprises induction coils 16 with different diameters, then the user may select the induction coil 16 in dependence of the bottom area of the cooking pot. Further, the user may select the cooking pot adapted to the area of the induction coil 16.

The induction cooking hob 10 comprises a pot detection system. The pot detection system includes a number of sensors for detecting the presence and the position of a cooking pot. The pot detection system is electrically connected to the control unit and/or to the user interface 14.

The diameters of the bottom areas of the most cooking pots are bigger than the diameters of these induction coils 16. However, the bottom areas of some cooking pots may be substantially equal as the areas of the induction coils 16. For example, the bottom area of a pot for preparing mocha coffee is often smaller than the area of the induction coils 16. If the bottom area of the cooking pot is only marginally bigger than the area of the induction coil 16, then the user may exactly place the cooking pot above the induction coil 16, so that the cooking pot and the induction coil 16 are arranged concentrically to each other. The concentric arrangement of the cooking pot and the induction coil 16 allows a maximum power transfer.

Although an illustrative embodiment of the present invention has been described herein with reference to the accompanying drawing, it is to be understood that the present invention is not limited to that precise embodiment, and that various other changes and modifications may be affected therein by one skilled in the art without departing from the scope or spirit of the invention. All such changes and modifications are intended to be included within the scope of the invention as defined by the appended claims.

LIST OF REFERENCE NUMERALS

10 induction cooking hob
12 cooking surface
14 user interface
16 induction coil
18 identification symbol, cross
20 longitudinal stripe
22 transverse stripe

What is claimed is:

1. An induction cooking hob with a plurality of induction coils, the induction cooking hob comprising:

a cooking surface having a cover plate and a control unit, wherein the induction coils are arranged side-by-side according to a predetermined scheme and below the cover plate, and wherein at least one induction coil is marked by an identification symbol that includes a first element and a second element, wherein the first element traverses a perimeter of, thereby extending beyond a diameter of, the corresponding induction coil, and the second element marks the diameter of said induction coil, wherein the identification symbol is a cross, and wherein the first element and the second element are formed as stripes of said cross.

2. The induction cooking hob according to claim 1, wherein the cross includes a longitudinal stripe and a transverse stripe, wherein the longitudinal stripe extends beyond the diameter of the corresponding induction coil and the transverse stripe marks the diameter of said induction coil.

3. The induction cooking hob according to claim 1, wherein the cross includes a longitudinal stripe and a transverse stripe, wherein the transverse stripe extends beyond the diameter of the corresponding induction coil and the longitudinal stripe marks the diameter of said induction coil.

4. The induction cooking hob according to claim 1, wherein the induction cooking hob comprises a pot detection system for detecting a presence and/or a position of a cooking pot on the cooking surface.

5. The induction cooking hob according to claim 4, wherein the pot detection system activates induction coils that are completely covered by a cooking pot.

6. The induction cooking hob according to claim 4, wherein the pot detection system activates induction coils that are at least partially covered by a cooking pot when a predetermined minimum portion of an area of said induction coils is covered.

7. The induction cooking hob according to claim 1, wherein the at least one induction coil marked by the identification symbol has a diameter between 50 mm and 90 mm.

8. The induction cooking hob according to claim 1, wherein the at least one induction coil marked by the identification symbol is provided for a cooking pot whose bottom area has a diameter between 50 mm and 90 mm.

9. The induction cooking hob according to claim 1, wherein the induction coils are arranged as a matrix, wherein the cooking surface comprises at least one portion in which the induction coils have the same diameters.

10. The induction cooking hob according to claim 1, wherein the identification symbol is applied on the cover plate of the cooking surface.

11. The induction cooking hob according to claim 1, wherein the plurality of induction coils comprises a first induction coil and a second induction coil, and the first induction coil is smaller than the second induction coil, and the first induction coil is marked by the identification symbol.

12. The induction cooking hob according to claim 4, wherein the induction cooking hob comprises a user interface electrically connected to the control unit and/or to the pot detection system.

13. The induction cooking hob according to claim 1, wherein the cover plate is a glass ceramic panel.

14. The induction cooking hob according to claim 1, wherein at least one of the plurality of induction coils is not marked by any identification symbol.

15. The induction cooking hob according to claim 7, said at least one induction coil marked by the identification symbol having a diameter of 70 mm.

* * * * *